US006364034B1

(12) United States Patent
Schoeffler

(10) Patent No.: US 6,364,034 B1
(45) Date of Patent: Apr. 2, 2002

(54) DIRECTIONAL DRILLING APPARATUS

(76) Inventor: William N Schoeffler, 214 Carmel Dr., Lafayette, LA (US) 70501

( * ) Notice: Subject to any disclaimer, the term of this patent is extended or adjusted under 35 U.S.C. 154(b) by 0 days.

(21) Appl. No.: 09/499,834

(22) Filed: Feb. 8, 2000

(51) Int. Cl.[7] ..... E21B 44/00

(52) U.S. Cl. ..... 175/38; 175/74; 175/101; 175/106; 175/113; 175/256; 175/325.2

(58) Field of Search ..... 175/24, 38, 61, 175/73, 74, 101, 106, 113, 256, 322, 325.2

(56) References Cited

U.S. PATENT DOCUMENTS 4,895,214 A 1/1990 Schoeffler
5,259,467 A * 11/1993 Schoeffler
5,305,838 A * 4/1994 Paue
5,375,671 A * 12/1994 Horvei
5,450,914 A * 9/1995 Coram
5,503,235 A * 4/1996 Falgout
5,529,133 A * 6/1996 Eddison
5,617,926 A * 4/1997 Eddison et al.
5,673,765 A * 10/1997 Wattenburg et al.

* cited by examiner

*Primary Examiner*—Roger Schoeppel
(74) *Attorney, Agent, or Firm*—John D. Jeter

(57) ABSTRACT

The apparatus has a housing which is secured to the lower end of a drilling motor body and carries an arbor that is secured to the output shaft of the motor. The arbor has three segments serially connected by gimbals. The upper segment is axially fixed by the bearings of the motor and has a lower end that extends when actuated to push the center segment downward. Axial movement of the center segment actuates a cam to move it laterally. The lower segment extends from the housing as an output shaft. It is arranged to tilt relative to the housing and its upper end is moved laterally by the gimbal connected center segment. The resulting tilt of the rotating axis of the output shaft causes an attached drill head to drill a deflected well bore.

8 Claims, 2 Drawing Sheets

DIRECTIONAL DRILLING APPARATUS

This invention pertains to down hole drilling equipment utilizing down hole drilling motors for straight and directional drilling. More particularly it relates to apparatus to be attached to the drilling motor body and motor output shaft, as an extension of the drilling motor, for selectively deflecting the rotational centerline of a drill head.

BACKGROUND

Directional drilling utilizing down hole motors is an established art with many forms of apparatus, for attachment to motors, designed for particular purposes. Particular needs relate to the ability to choose the configuration of the down hole assembly to drill straight ahead or laterally deflect the drill head, for directional drilling, without loss of time in tripping the drill string. Ideally, the configuration change should result from the selective manipulation of an existing influence such as drilling fluid flow rate. Down link controls by such means as electrical conductors inside the drill string have been used but that imposes an additional burden on the drilling operation. Objects such a balls and spears have been dropped down the drill string bore to cooperate with receiving contrivances down hole to cause desired changes in the behavior of the down hole assembly. Again, that activity utilizes equipment and actions not already essential to drilling. The mud pumps and controls are essential to drilling. Their use, in manipulating down hole apparatus, introduces nothing new to the system and the required manipulations of the flow rate can be carried out with the mud pump throttle. Such down link command systems are in current use in several forms and are preferred for control of the present invention.

SUMMARY OF INVENTION

The apparatus is part of a length of drill string that includes a down hole drilling motor. A drill head normally completes the assembly and is attached to the output shaft of the apparatus. Drilling fluid flows down the drill string, through the drilling motor, the apparatus and, finally, out the ports of the drill head. A housing to contain the apparatus is attached to the body of the drilling motor. The apparatus has a flexible drive shaft, or arbor, that drives the drill head, is bearingly supported in the housing, and is attached to the drilling motor output shaft at the upper end and the drill head at the lower end. The motor output shaft is axially and radially supported within the motor, hence, it is axially and radially fixed relative to the apparatus housing. The arbor consists essentially of three major, flexibly connected and rotationally connected segments. The upper segment is mounted on the motor shaft and rotates about a fixed centerline and has a spline connected lower portion that is axially movable to extend it's length. The center segment is gimbal connected to the lower end of the upper segment and upper end of the lower segment. The center segment moves rotationally and can be displaced axially within the housing. The center segment has a mid-length laterally deflecting arrangement that causes it to move laterally when it is moved axially. With the upper segment radially supported on the apparatus centerline, that deflection causes the lower end of the center segment to move a greater amount laterally. The lower end of the center segment is gimbal connected to the upper end of the lower segment which pivots about a hinge point on the housing to cause it's lower end to deflect. That lower end carries the drill head. Deflection of the drill head relative to the housing, and the well bore, causes the overall assembly to drill an advancing hole being drilled that departs from the original well bore centerline. The hinge point is in a ball arrangement that is mounted in a bearing assembly in the housing. It is axially fixed but rotates relative to the housing and is rotationally and axially secured to the lower segment. The lower segment has an upper end that telescopes to accept the axial movement of the center segment. It is spring loaded to urge the center segment upward.

A flow bore extends through the arbor to receive mud from the motor shaft and deliver it to the drill head.

The center segment is deflected by a camming sleeve, mounted for rotation relative to the segment and axially affixed thereto. The sleeve slides along a bore in the housing when the center segment moves axially. Axial movement of the sleeve, in cooperation with cam surfaces on the bore, pushes the center segment laterally.

Axial movement of the arbor is confined to the lower end of the upper segment, all of the center segment, and the upper end of the lower segment. The axial movement is powered by drilling fluid pressure acting on a piston surface in the upper segment, with the reference pressure existing in the general enclosure of the housing. The general enclosure pressure is defined by a vent from the flow bore to the enclosure of the housing.

A selector valve is situated in the flow bore within the center segment and, when closed, causes a pressure difference between the upper and lower reaches of the flow bore that extends through all three segments. The pressure in the flow bore above the closed valve is greater than that below the valve, and the flow bore below the valve is vented to the housing general enclosure, and that pressure difference actuates the piston. When the valve is open the pressure difference on the actuator piston is caused only by flow related pressure loss in the flow bore between the piston and the point of venting to the enclosure.

To insure that the deflecting means responds only to a closed selector valve the camming sleeve has optional sealing surface, or seal ring, that cooperate with sealing surfaces on the housing to fluidly separate the enclosure into upper and lower chambers. The chambers are sealingly separated only in the non-deflected state. The flow bore vent is below the camming sleeve. When the apparatus is in the straight drilling configuration, the pressure difference across the camming sleeve produces an upwardly directed piston force. That force cancels the tendency for flow losses in the flow bore to actuate the deflecting piston when the selector valve is open.

Further steps to prevent inadvertent deflection include an optional controlled vent from the enclosure above the camming sleeve through the housing wall to drain pressure at a limited rate from the upper chamber to the well bore. The vent speeds up the arbor straightening action when the selector valve is opened. That vent also accepts some leakage from the flow bore or motor drive shaft seal above the sleeve without producing a downward force on the camming sleeve, and prevents lock up when the seal ring is being extracted from the cooperating sealing surface for downward movement. The controlled vent is small compared to the vent in the flow bore. When the sleeve moves away from the sealing position the vent in the flow bore effectively defines the pressure in the general enclosure.

It is therefore an object of this invention to provide apparatus attachable to a drilling motor to change the apparatus between a straight hole drilling configuration a directional drilling configuration in response to signals received from the surface.

It is another object to provide apparatus that responds to manipulations of the drilling fluid flow rate, generated at the surface, to change the configuration of the apparatus during brief interruptions in the drilling activity.

It is yet another object to provide intrinsic compensation to prevent the apparatus from responding to high flow rate pressure losses in the apparatus from shifting unintentionally to the directional configuration.

These and other objects, advantages, and features of this invention will be apparent to those skilled in the art from a consideration of this specification, including the attached claims and appended drawings.

BRIEF DESCRIPTION OF DRAWINGS

In the drawings wherein like features have similar captions.

DETAILED DESCRIPTION OF DRAWINGS

Figure 1:
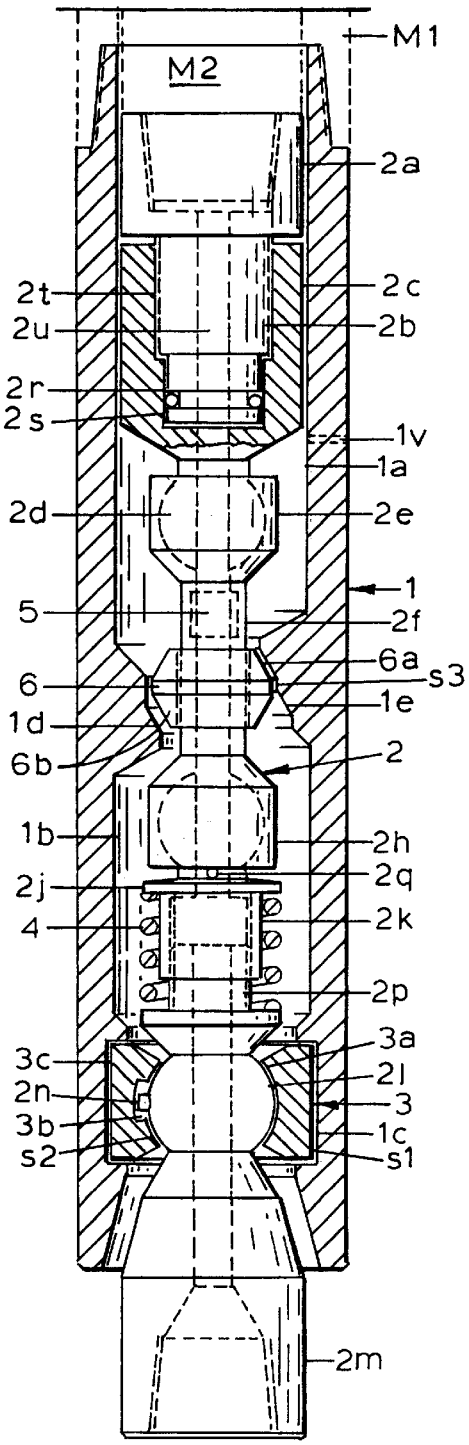
FIG. 1 is a side view, mostly cut away of the preferred embodiment.

In the drawings, some details of construction that are well established in the art, and having no bearing upon points of novelty, are omitted in the interest of clarity of descriptive matter. Such excluded details may include weld lines, threaded junctions, threaded fasteners, pins, and specific design features of seals and gaskets.

In FIG. 1 housing 1 is attached to the motor body M1 by a fluid tight connection. Arbor 2 is threadedly connected to the motor output shaft M2 by a fluid tight connection. All rotating parts that deliver fluid and power from the motor to the drill head are defined as an arbor. The arbor consists of three main segments, an upper, a center, and a lower. The upper segment telescopes to move it's lower portion downward. The upper segment comprises rotor connection 2*a* with splined extension 2*b* and piston 2*s* and allows trunnion 2*c* to move gimbal ball 2*d* downward. Mating splines 2*t* and cylinder bore 2*r* conduct torque and assure radial stability of ball 2*d*. The center segment has ball gimbal boxes 2*e* and 2*h* spaced apart by shaft 2*f*. Camming sleeve 6 is secured to the shaft and axially and radially affixed but free to rotate relative to the shaft.

The housing enclosure is divided into upper chamber 1*a* and lower chamber 1*b* by the cam arrangement 1*d* and 1*e* which cooperates with camming sleeve 6. Sleeve 6 carries sealing ring s3. The camming sleeve is effectively a piston dividing the chambers when the apparatus is in the straight configuration. When the camming sleeve moves downward, the seal ring s3 is no longer effective. When pressure in the upper chamber is lower than the pressure in the lower chamber the camming sleeve, as a second piston, opposes the actuator piston.

Lateral force producing means comprises cam surfaces 1*d* and 1*e* acting against cam follower surfaces 6*b* and 6*a* respectively when ring 6 is moved axially.

The cams are arranged to move camming sleeve 6 laterally, when it moves axially, along a line that lies in a vertical plane. The vertical plane defines a line known as a scribe line which usually defines the direction of deflection of the drill head. The scribe line would lie in the plane of the drawing, on the left side.

Vent 2*q* opens into the lower enclosure 1*b*. When the arbor is straight, enclosure 1*b* is sealed from enclosure 1*a* by seal ring s3. Vent 1*v* prevents pressure build-up in the upper enclosure and vent 2*q* maintains some pressure in the lower enclosure.

Output shaft 2*m* is gimbal mounted as spherical shape 21 in mating spherical opening 3*a*. Bearing surface 3*c* spins in cylindrical enclosure 1*c*. Spring 4 acts against flange 2*j* to move connector 2*h* upward, straightening the arbor.

The lower segment rotates about it's axis through bearing pack 3 which supports gimbal ball 21. The bearing pack is shown symbolically. The practical bearing is sealed and differs in apparatus of different sizes. Pin 2*n* drives the bearing through slot 3*b*. The tilt of the lower segment axis can be called a hinge arrangement because the cam surfaces cause the axis of the segment to remain in one plane relative to the housing. The tilt is about a stable transverse line relative to the housing. The bearing pack has seals s1 and s2 to separate the enclosure from the well bore.

Axial movement is initiated by closing selector valve 5 in bore 2*u* in the center segment to raise the pressure on the piston face in bore 2*r*. Trunnion 2*c* carries the ball 2*d* and it is pushed down by action of the piston. The gimbal connected center segment including gimbal socket 2*e*, shaft 2*f* and gimbal 2*h* is pushed down. The downward movement is accepted by the telescoping splines 2*p* and 2*k* at the upper end of the lower segment. The downward movement of the center section moves camming sleeve surface 6*b* along cam surface 1*d* to cause lateral deflection seen in FIG. 2 and causes the lower segment to deflect it's rotational centerline.

The spring 4 urges the upward movement of the upper portion 2*j* of the lower segment urging the center segment, and the lower portion 2*c* of the upper segment upward. Upward movement takes place when the drilling fluid flow rate is reduced.

During upward movement of the center segment, the camming sleeve surface 6*a* engages the lateral forcing cam face 1*e* and moves the center segment toward the housing centerline. That movement straightens the axis of rotation of the lower segment and puts the apparatus In the straight drilling configuration as seen in FIG. 1, and allows seal ring s3 to engage a complete circle on the housing.

In the preferred embodiment, the selector valve will not close on the next onset of drilling fluid flow and the downward movement will not take place. If once again the fluid flow is reduced and then increased, both changes within selected limits, the valve will close and downward movement will take place.

The selector valve can be one arranged to be actuated by any means such as a ball or spear dropped down the drill string bore. The preferred valve is described in FIGS. 3, 4 and 5.

Figure 2:
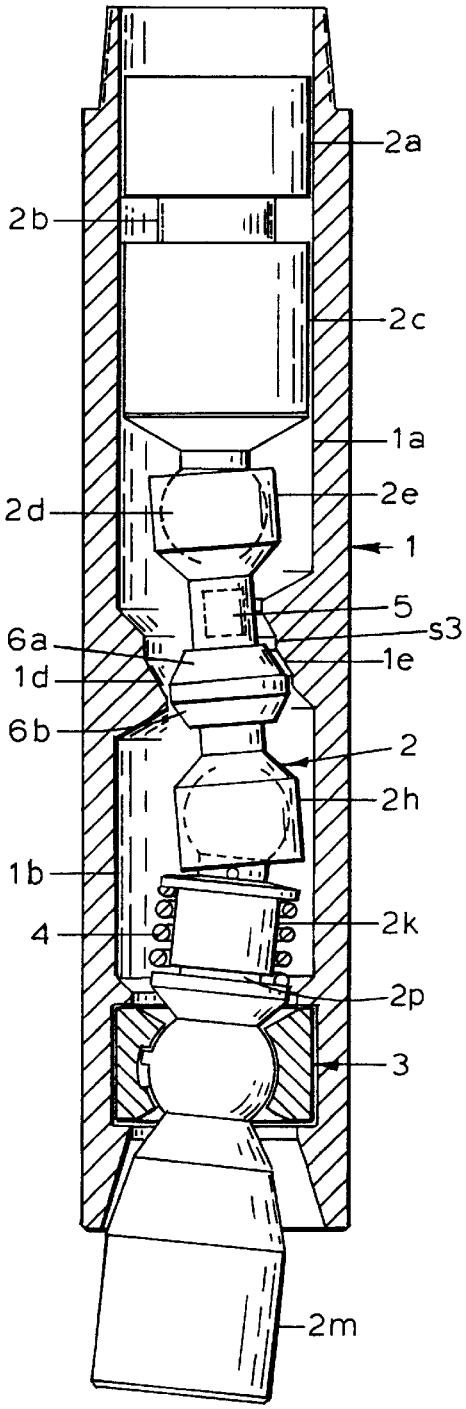
FIG. 2 is a side view, mostly cut away, the same as FIG. 1 in the deflected configuration.
Figure 3:
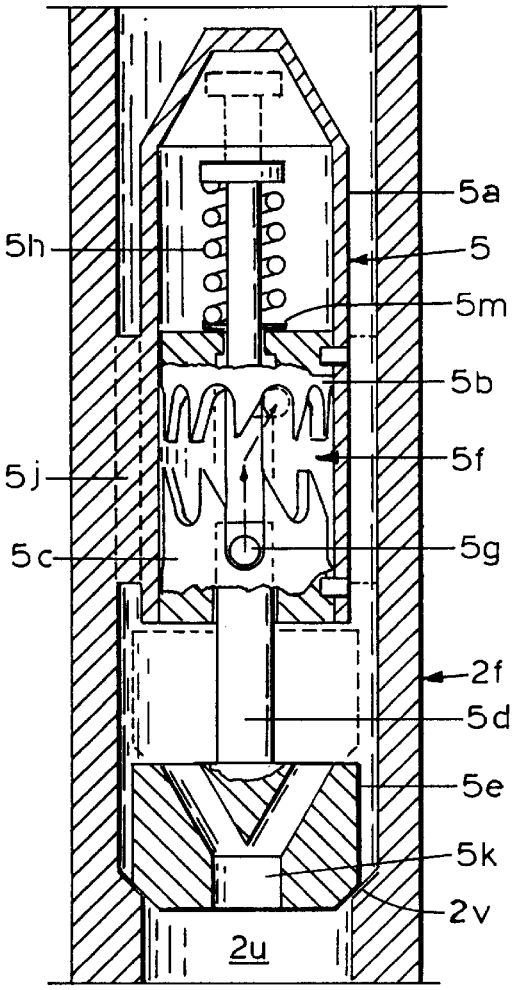
FIG. 3 is an elevation, in cutaway and somewhat enlarged, of the selector valve of FIGS. 1 and 2

In FIG. 3 the preferred selector valve 5 of FIGS. 1 and 2 is shown rather enlarged. Arbor shaft tube 2*f* has valve body 5*a* suspended in the bore by three spiders 5*j*. The body is shown somewhat oversize to more clearly describe elements but drilling fluid flows down the annulus between the bore 2*u* of tube 2*f* and the body 5*a*. Cams 5*b* and 5*c* are secured in the body and spaced to provide serpentine path 5*f* to accommodate the crosshead pin 5*g* on shaft 5*d*. The cam arrangement is known as a walk around cam. Up and down movement of pin 5*g*, caused by flow rate changes, and consequent movements of poppet 5*e*, moves the pin around the groove endlessly. The cam system provides three possible axial positions. The top position results from a no flow condition. The middle position is a transition position in which the valve has little effect upon the stream. The lower position closes the selector valve. Channel 5*k* allows fluid to by-pass the valve to drive a down hole motor, or other devices. Friction bearing 5*m* allows the shaft 5*d* to turn but prevents wandering of the cross head due to fluid turbulence so that it will be rotated only by the cams.

Figure 4:
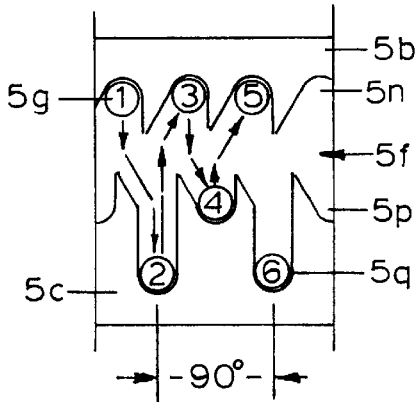
FIG. 4 is a development of the serpentine cam system of FIG. 3.

The valve control cam arrangement is now described with reference to FIGS. 3, 4, and 5. Only a representative portion of the cam periphery is shown developed in FIG. 4. The cams have pockets and ramps to compel the crosshead pin to move along a specific path when it moves between up and down travel limits. The cams shown have eight upper pockets 5*n* on forty-five degree spacing. There are four intermediate pockets 5*p* and four lower pockets 5*q*, each set equally distributed about the cam periphery. Starting with position 1, one end of crosshead pin 5*g* is shown in position 1 of the upper pockets 5*n*. The first downward excursion moves the pin to position 2 of the 5*p* pockets. The next upward excursion takes the pin to position 3. The next downward excursion moves the pin to position 4 in an intermediate pocket 5*p*. Positions 5 and 6 follow similarly and the pin can progress endlessly around the serpentine groove. The depth of the intermediate and lower pockets determine the lowest position the poppet can occupy. In this configuration, alternate downward excursions allow the poppet to close the valve. Pressure in the mud stream at the surface will indicate if the valve is closed. To open the valve, the mud flow is manipulated at the surface to allow the pin to make one more up and down excursion.

Referring to FIG. 3, the fluid entrains poppet 5*e*, which is larger than the body 5*a*, and will move it to engage the seat 2*v* as shown if the carrier shaft 5*d* is permitted to travel that far. The reduced bore continues as 2*u*. The valve is shown in the closed state with dashed lines showing the fully open valve position to which the poppet is urged when fluid flow is reduced. Shaft 5*d* has crosshead pin 5*g* which is shown urged into pocket 5*q* (position 2) of the serpentine groove 5*f* as shown in FIG. 4. The open position shown in dashed lines results from the force of spring 5*h* moving the cross head pin upward to position 3 in one of the pockets 5*n*.

By design choice the pockets can be distributed in a variety of series, such as two or more lower pockets between each intermediate pocket. Likewise, a plurality of intermediate pockets can be placed between the lower pockets. The purpose to be served, in the expected drilling situation, dictates such distributions.

The valve poppet 5*e* is shown to engage the seat 2*v*. By design choice, the by-pass effect of channel 5*k* can be achieved by making the poppet smaller than the diameter of the restriction cooperating with the poppet and allowing fluid to by-pass between poppet and restriction. The upper end of the poppet can still be large enough to produce entrainment with the fluid stream. Such arrangements are anticipated by and are within the scope of the claims.

Figure 5:
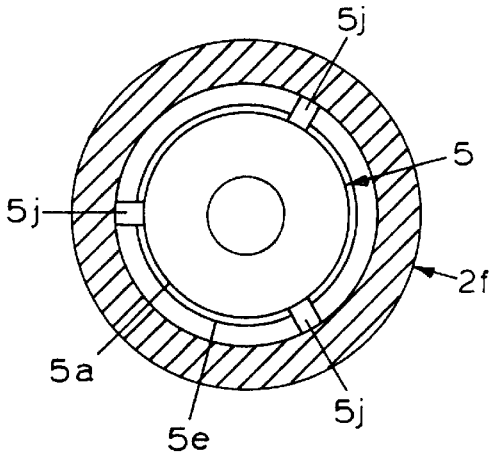
FIG. 5 is a top view of the apparatus of FIG. 3.

In FIG. 5 it can be seen that most elements are generally cylindrical. The cams (not shown in FIG. 5) are generally cylindrical is cross section.

From the foregoing, it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

I claim:

1. A drilling motor deviation control apparatus for use as a length element of a fluid conducting drill string for use in wells, the apparatus comprising:

a) a down hole drilling motor having a rotor bearingly supported in a body;

b) an elongated, generally cylindrical, housing with means for fluid tight attachment to the body of said motor;

c) a flexible arbor carried in said housing, with means at a first end for fluid tight attachment to said rotor, and means at the second end for fluid tight attachment to a downwardly continuing drill string element below said housing, said arbor having a rigid length extending from said housing at said second end and having means for hinged attachment to said housing to accept angular change between straight drilling and directional drilling configurations;

d) a fluid flow channel in said arbor arranged to receive drilling fluid from said rotor and conduct said fluid to said second end for delivery to said element;

e) a selector valve in said housing situated to variably resist said fluid flow in said channel, responsive to signals from the surface, to change between an open state and a closed state;

f) a piston in said housing, responsive to said resistance in said channel, arranged to move between first and second positions in response to said changes of state;

g) lateral force producing means in said housing, responsive to movement of said piston between said first and said second positions, to move said rigid length between said straight drilling and directional configurations.

2. The apparatus of claim 1 wherein a first vent is provided to vent said channel, on the down stream side of said selector valve, into the general enclosure of said housing, and differential pressure active on said piston is provided by said channel upstream of said valve and the down stream side of said valve.

3. The apparatus of claim 1 wherein the general enclosure of said housing is divided into an upper and a lower chamber by a sealable periphery, a second piston carried by said arbor such that said second piston is in sealing engagement with said periphery when said first piston is in said first position and in a non-sealing position when said piston is not in said first position, said vent in said lower chamber.

4. Apparatus for attachment to down hole well drilling motors, that have a power output rotor carried by a motor body, to extend the motor and serve as a length of downwardly continuing drill string, the apparatus comprising:

a) an elongated generally cylindrical housing with means at a top end for fluid tight attachment to said body;

b) a torque conducting arbor situated in said housing with means at the top end for fluid tight attachment to said rotor and to extend from the bottom end of said housing to provide a length of rigid drive shaft for a downwardly extending drill string element, said arbor having a channel to receive drilling fluid from said rotor and deliver said fluid to said downwardly continuing drill string element;

c) a selector valve in said housing situated to move between opened and closed state, in response to signals from the surface, to variably resist flow of fluid in said channel to change the pressure drop across said valve;

d) a fluid power cylinder situated in said housing and responsive to said change in pressure drop to move between first and a second positions;

e) hinge means in said housing to axially and radially attach said rigid length thereto, arranged to permit said rigid length to pivot to change between straight drilling and directional drilling configuration;

f) deflection control means in said housing, responsive to the change of said cylinder between said first and second positions to move said hinge means to change said configuration.

5. The apparatus of claim 4 wherein said housing has an enclosure that is divided into an upper and a lower chamber, with the fluid in said channel vented to said lower chamber, said upper chamber vented to the atmosphere outside said housing, and wherein a piston is provided to react to pressure difference between said chambers to oppose said cylinder when said rigid length is in said straight configuration, said piston being disabled when said rigid length leaves said straight configuration.

6. The apparatus of claim 4 wherein said arbor comprises three flexibly connected rigid segments, an upper, a center, and said rigid length as a lower segment, with the segments serially connected by fluid tight, rotationally connected gimbals, said center section laterally movable to accept said deflection of said lower segment.

7. The apparatus of claim 4 wherein said upper and lower segments have telescoping ability to allow said center segment to move axially relative to said housing.

8. The apparatus of claim 7 wherein said selector valve is in said center segment, said piston is in said upper segment, said vent to said enclosure is below said valve, said piston moves said center segment axially, and said deflection control means acts laterally upon said center section in response to said axial movement to cause said rigid length to change between straight drilling and said directional drilling configurations.

* * * * *